US007504923B1

(12) United States Patent
Lin et al.

(10) Patent No.: US 7,504,923 B1
(45) Date of Patent: Mar. 17, 2009

(54) INDUCTOR STRUCTURE

(75) Inventors: Hsiao-Chu Lin, Taipei Hsien (TW); Sheng-Yuan Lee, Taipei Hsien (TW)

(73) Assignee: Via Technologies, Inc., Taipei Hsien (TW)

( * ) Notice: Subject to any disclaimer, the term of this patent is extended or adjusted under 35 U.S.C. 154(b) by 0 days.

(21) Appl. No.: 11/966,815

(22) Filed: Dec. 28, 2007

(30) Foreign Application Priority Data

Nov. 1, 2007 (TW) ..... 96141203 A

(51) Int. Cl.
*H01F 5/00* (2006.01)

(52) U.S. Cl. ..... 336/200; 336/232; 336/223

(58) Field of Classification Search ..... 336/200, 336/223, 232
See application file for complete search history.

(56) References Cited

U.S. PATENT DOCUMENTS 7,068,140 B2 * 6/2006 Chou ..... 336/200
7,084,481 B2 * 8/2006 Lowther et al. ..... 257/531
7,095,307 B1 * 8/2006 Barrett et al. ..... 336/200
7,382,222 B1 * 6/2008 Manetakis ..... 336/200
2003/0001709 A1 * 1/2003 Visser ..... 336/200
2003/0071706 A1 * 4/2003 Christensen ..... 336/200
2004/0017278 A1 * 1/2004 Castaneda et al. ..... 336/200

* cited by examiner

*Primary Examiner*—Anh T Mai
(74) *Attorney, Agent, or Firm*—J.C. Patents

(57) ABSTRACT

An inductor structure disposed over a substrate and comprising a first spiral wire and a second spiral wire is provided. The first spiral wire has a first end and a second end. The first end rotates in a spiral way outward from an inner portion of the first spiral wire. The second spiral wire and the first spiral wire are intertwisted with each other and symmetrically disposed about a symmetry plane. The second spiral wire has a third end and a fourth end. The third end rotates in a spiral way outward from an inner portion of the second spiral wire and is connected to the first end of the first spiral wire, so as to form a coil layer having a plurality of coil turns.

20 Claims, 5 Drawing Sheets

INDUCTOR STRUCTURE

CROSS-REFERENCE TO RELATED APPLICATION

This application claims the priority benefit of Taiwan application serial no. 96141203, filed on Nov. 1, 2007. The entirety of the above-mentioned patent application is hereby incorporated by reference herein and made a part of this specification.

BACKGROUND OF THE INVENTION

1. Field of the Invention

The present invention relates to an inductor structure. More particularly, the present invention relates to an inductor structure having an improved inductor quality.

2. Description of Related Art

Generally speaking, inductors store and release energy through the mutual transformation between electricity and magnetism, so the inductors may be used as a component for stabilizing current. Moreover, in integrated circuits (IC), inductors are very important components but full of challenge. Besides, the inductors have wide applications, for example, in radio frequency (RF) field. In the high frequency field, the inductors are required to have a high quality, i.e., the inductors must have a high quality factor, which is represented by a Q value. The Q value is defined as follows: $Q=\omega\times L/R$ where $\omega$ is the angular frequency, L is the wire inductance, and R is the resistance considering inductance loss under specific frequencies.

In general, various methods and techniques have been proposed for integrating an inductor and an IC process. However, in the IC, the limitation of the thickness of the inductor and the interference of a silicon substrate to the inductor lead to a poor quality of the inductor. In a conventional art, a thick metal is disposed on the top layer of the inductor, so as to reduce the conductor loss, and raise the Q value of the inductor.

However, although having a thick metal at the top layer, the inductor structure may still be influenced by an eddy current. As the inner coil turn has the maximum magnetic flux, the inner portion of the inner coil turn is most affected by the eddy current. Thus, the current of the inner coil turn is not uniform, and the cross-sectional area of the conductor cannot be fully utilized, which reduces the inductor quality.

SUMMARY OF THE INVENTION

The present invention is directed to an inductor structure, capable of alleviating the impact of the eddy current, so as to improve the inductor quality.

The present invention provides an inductor structure, which is disposed over a substrate and comprises a first spiral wire and a second spiral wire. The first spiral wire has a first end and a second end. The first end rotates in a spiral way outward from an inner portion of the first spiral wire. The second spiral wire and the first spiral wire are intertwisted with each other and symmetrically disposed about a symmetry plane. The second spiral wire has a third end and a fourth end. The third end rotates in a spiral way outward from an inner portion of the second spiral wire and is connected to the first end of the first spiral wire, so as to form a coil layer having a plurality of coil turns.

The present invention further provides another inductor structure, which is disposed over a substrate and comprises a first spiral wire and a second spiral wire. The first spiral wire at least comprises a first outer wire and a first inner wire. The first outer wire is connected in series with the first inner wire, and the first outer wire rotates in a spiral way outward from an inner portion of the first spiral wire. The second spiral wire and the first spiral wire are intertwisted with each other and symmetrically disposed about a symmetry plane. The second spiral wire at least comprises a second outer wire and a second inner wire. The second outer wire is connected in series with the second inner wire, and the second outer wire rotates in a spiral way outward from an inner portion of the second spiral wire and is connected to the first outer wire, so as to form a coil layer having a plurality of coil turns.

In order to make the aforementioned and other objectives, features, and advantages of the present invention comprehensible, embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
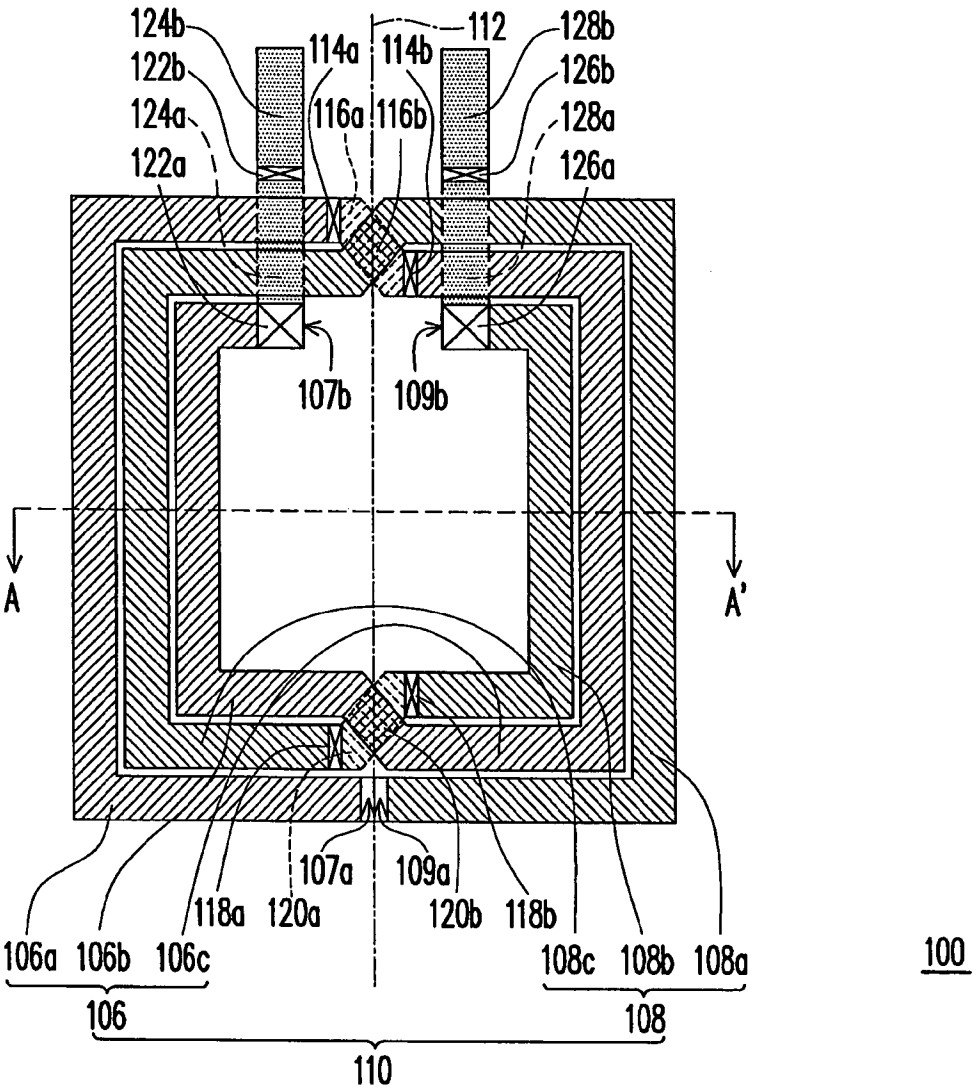
FIG. 1 is a top view of an inductor structure according to an embodiment of the present invention.
Figure 2:
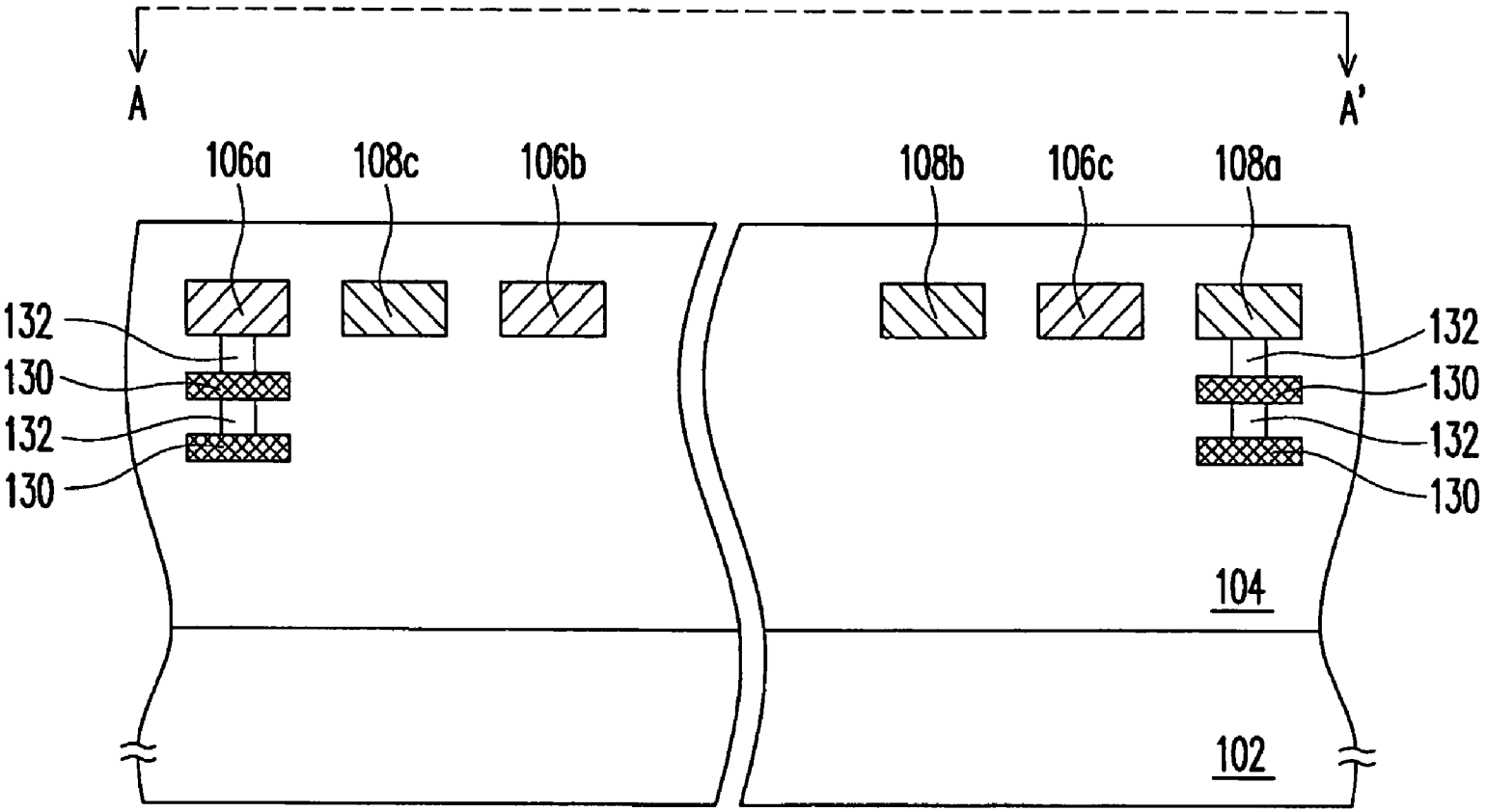
FIG. 2 is a cross-sectional view taken along A-A' line in FIG. 1.

FIG. 1 is a top view of an inductor structure according to an embodiment of the present invention. FIG. 2 is a cross-sectional view taken along A-A' line in FIG. 1.

Referring to FIGS. 1 and 2 together, the inductor structure 100 is disposed in a dielectric layer 104 on a substrate 102. The inductor structure 100 comprises a spiral wire 106 and a spiral wire 108. As the inductor structure 100 may be fabricated by a semiconductor process, the substrate 102 may be a silicon substrate. The material of the dielectric layer 104 is, for example, silicon oxide or other dielectric materials. The material of the spiral wires 106, 108 may be a metal, such as Cu or Cu—Al alloy. Further, in this embodiment, the shape of the inductor structure 100 is, but not limited to, quadrangular (as shown in FIG. 1).

The spiral wires 106 and 108 are disposed, for example, on planes at the same level. The spiral wires 106, 108 are intertwisted with each other to form a coil layer 110 having a plurality of coil turns, and are symmetrically disposed about a symmetry plane 112. In addition, the symmetry plane 112 extends, for example, inward the paper.

The spiral wire 106 at least comprises an outer wire **106*a* and an inner wire 106*b*. The outer wire 106*a* is connected in series with the inner wire 106*b*. The spiral wire 106 has a first end 107*a* and a second end 107*b*. The first end 107*a* is, for example, an end of the outer wire 106*a*, and the second end 107*b* is, for example, an end of the inner wire 106*b*. That is, the second end 107*b* is disposed on the inner portion of the spiral wire 106, and the first end 107***a* rotates in a spiral way outward from the inner portion of the spiral wire 106.

The spiral wires 108 and 106 are intertwisted with each other and symmetrically disposed about the symmetry plane 112. The spiral wire 108 at least comprises an outer wire 108*a* and an inner wire 108*b*. The outer wire 108*a* is connected in series with the inner wire 108*b*. The spiral wire 108 has a third end 109*a* and a fourth end 109*b*. The third end 109*a* is, for example, an end of the outer wire 108*a*, and the fourth end 109*b* is, for example, an end of the inner wire 108*b*. The fourth end 109*b* is, for example, disposed on the inner portion of the spiral wire 108 and corresponding to the position of the second end 107*b*. The third end 109*a* is, for example, corresponding to the position of the first end 107*a*, and rotates in a spiral way outward from the inner portion of the spiral wire 108. Besides, the first end 107*a* and the third end 109*a* are connected on the symmetry plane 112. That is, the spiral wires 106, 108 coincide and are connected at the outermost coil turn of the coil layer 110.

As shown in FIG. 1, in this embodiment, the coil layer 110 of the inductor structure 100, for example, is a coil structure of three coil turns. Thus, the spiral wires 106, 108 further comprise at least one connection wire 106*c* and at least one connection wire 108*c* respectively. The outer wire 106*a* is, for example, connected in series with the inner wire 106*b* through the connection wire 106*c*. The outer wire 108*a* is, for example, connected in series with the inner wire 108*b* through the connection wire 108*c*. However, the number of the coil turns of the coil layer 110 is not limited to three in the above embodiment, and the connecting manner is not limited to the present invention either.

In another embodiment, in the situation that the coil layer 110 has two coil turns, the outer wire 106*a* may be directly connected in series with the inner wire 106*b*, and the outer wire 108*a* may also be directly connected in series with the inner wire 108*b*. Definitely, in the coil layer 110, several connection wires 106*c* may be disposed between the outer wire 106*a* and the inner wire 106*b*, and correspondingly, several connection wires 108*c* may be disposed between the outer wire 108*a* and the inner wire 108*b*. Thus, the coil layer 110 has a structure of more than three coil turns, which can be adjusted by those of ordinary skill in the art.

Figure 3:
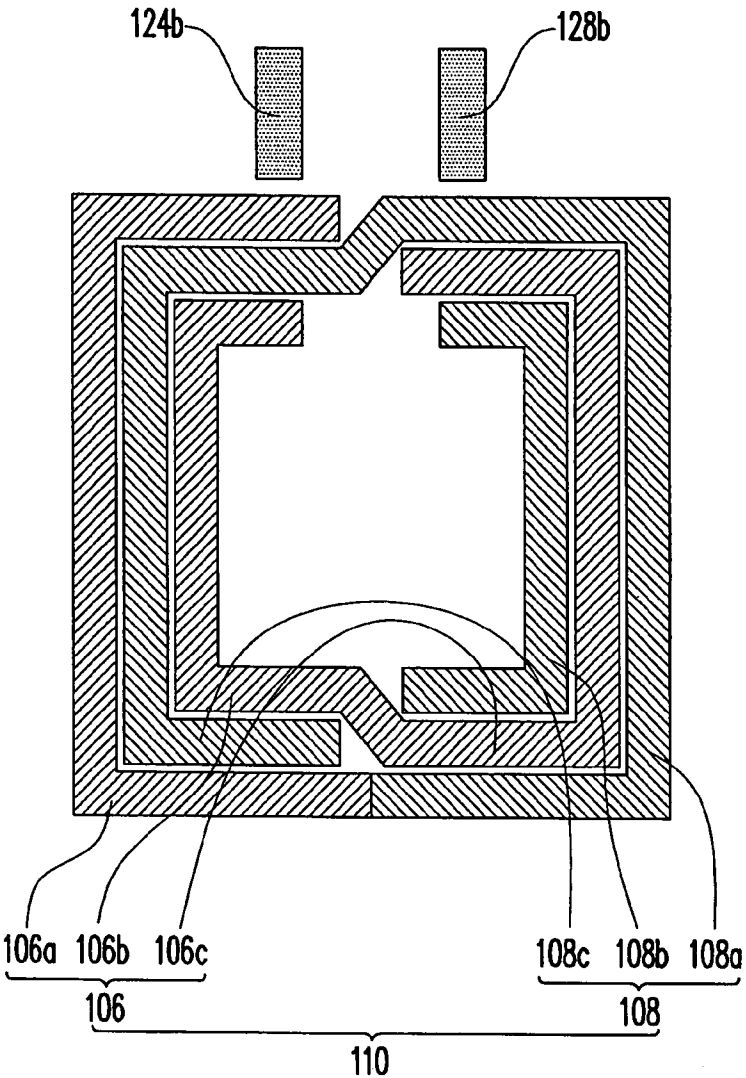
FIG. 3 is a top view of an upper layer of the inductor structure in FIG. 1.
Figure 4:
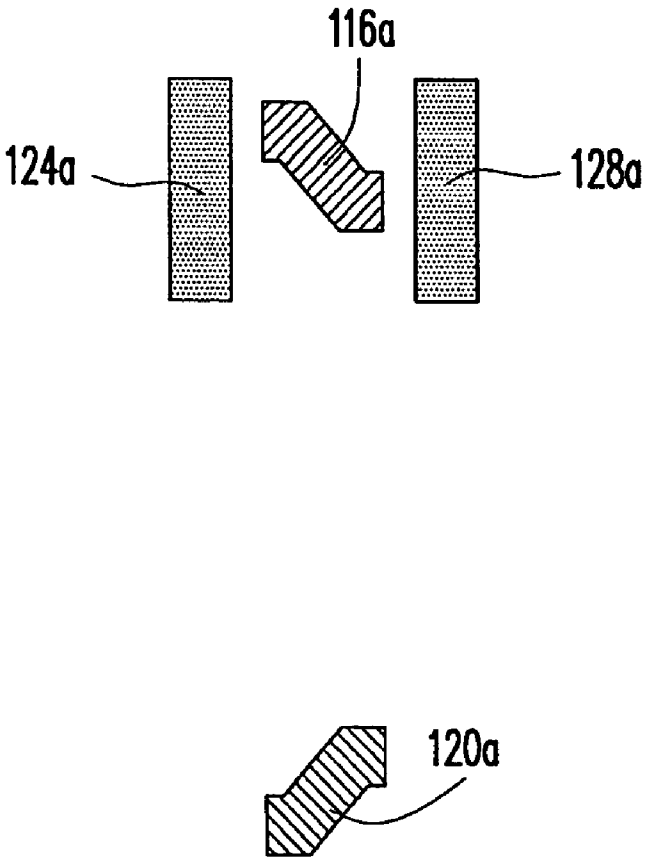
FIG. 4 is a top view of a lower layer of the inductor structure in FIG. 1.

FIG. 3 is a top view of an upper layer of the inductor structure in FIG. 1. FIG. 4 is a top view of a lower layer of the inductor structure in FIG. 1.

Referring to FIGS. 1, 3, and 4 together, the spiral wires 106 and 108 are intertwisted with each other as follows. For example, the spiral wires 106 and 108 are interlaced on the symmetry plane 112. Moreover, the spiral wire 106 and the spiral wire 108 are not in contact at the interlaced position, in order to avoid short circuit. For example, in the spiral wire 106, the outer wire 106*a* is, for example, connected downward to a joining wire 116*a* through a via 114*a*, and then connected to the connection wire 106*c* through an via 114*b*, thereby avoiding contacting the spiral wire 108 to cause short circuits. The outer wire 108*a* is connected to the connection wire 108*c* via a joining wire 116*b* on a plane of the same level. In another aspect, in the spiral wire 108, the connection wire 108*c* and the inner wire 108*b* are connected through, for example, a via 118*a*, a joining wire 120*a*, and a via 118*b*. The connection wire 106*c* and the inner wire 106*b* are connected through a joining wire 120*b* on a plane of the same level.

In view of the above, when the inductor structure 100 is operated, for example, operating voltages are respectively applied to the second end 107*b* and the fourth end 109*b* at the same time. An operating voltage is applied to the second end 107*b* in the following manner. For example, the second end 107*b* is connected to an external wire 124*a* disposed below the inductor structure 100 through a via 122*a*, and is then connected to an external wire 124*b* through a via 122*b*, such that the operating voltage may be applied to the second end 107*b* through the external wire 124*b*. Similarly, an operating voltage is applied to the fourth end 109*b* in the following manner. For example, the fourth end 109*b* is connected to an external wire 128*a* disposed below the inductor structure 100 through a via 126*a*, and is then connected to an external wire 128*b* through a via 126*b*, such that the operating voltage may be applied to the fourth end 109*b* through the external wire 128*b*.

As the voltages respectively applied to the second end 107*b* and the fourth end 109*b* are of a same absolute value and opposite electrical properties, starting from the second end 107*b* and the fourth end 109*b*, the absolute values of the voltages descends toward the exterior of the spiral wire 106 and the spiral wire 108. The voltage at the juncture of the first end 107*a* of the outer wire 106*a* and the third end 109*a* of the outer wire 108*a* is 0. That is, a virtual grounding is formed at the outermost coil turn of the coil layer 110, which is the application of a symmetrical differential inductor.

In view of the above, in the inductor structure 100, the grounded outermost coil turn has the most dense current, and the innermost coil turn of the inductor structure 100 is most affected by the eddy current. Therefore, the inductor structure 100 of this embodiment can effectively alleviate the impact of the eddy current, and improve the inductor quality.

Further, in the application of a direct current, a power supply wire is connected to the AC grounded coil turn. In the conventional art, the grounded coil turn is the innermost coil turn of the inductor structure, and thus the power supply wire must pass below the inductor structure, which will cause power loss. However, in the inductor structure 100 of the present invention, the AC grounded coil turn is the outermost coil turn of the inductor structure 100, so the power supply wire may be directly connected to the outermost coil turn of the inductor structure 100, instead of passing below the inductor structure 100, thus avoiding the power loss.

Figure 5:
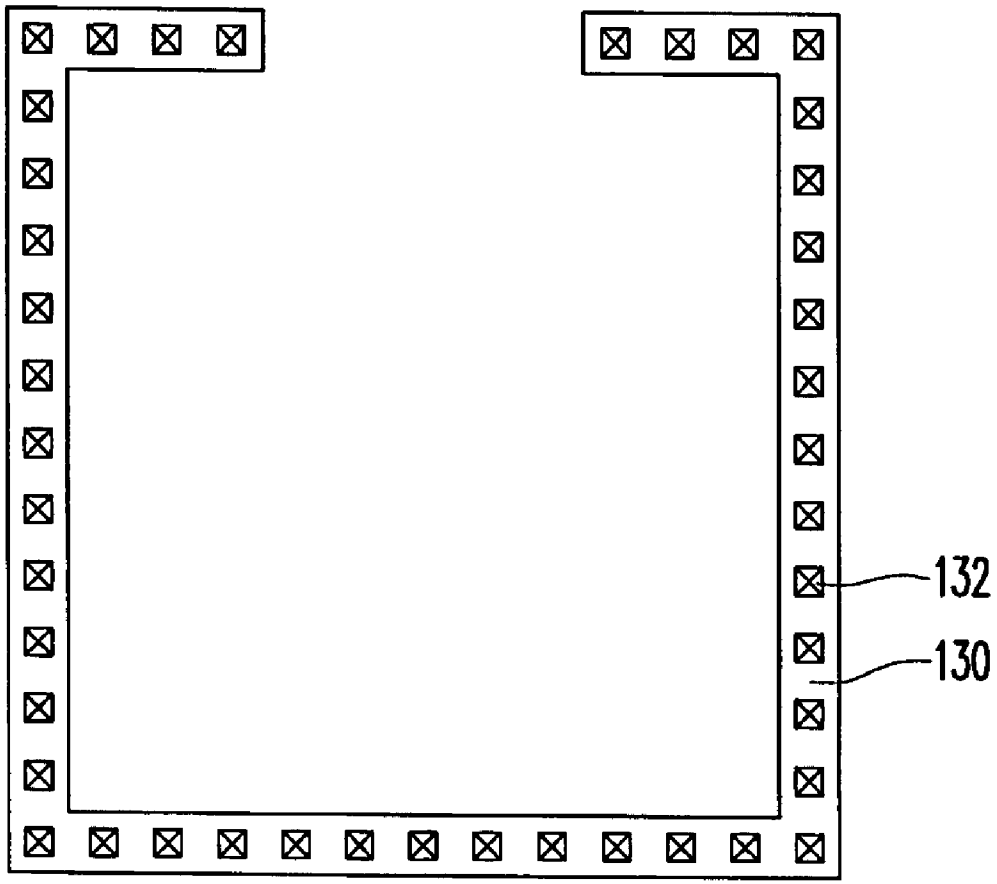
FIG. 5 is a top view of a gain wire according to an embodiment of the present invention.

FIG. 5 is a top view of a gain wire according to an embodiment of the present invention.

Referring to FIGS. 2 and 5 together, the inductor structure 100 further comprises a gain wire 130. The gain wire 130 corresponding to the projection of the outermost coil turn of the coil layer 110 is disposed below the coil layer 110, and is connected in parallel with the outermost coil turn of the coil layer 110. That is, the outer wires 106*a*, 108*a* at the outermost coil turn of the coil layer 110 may be connected to the gain wire 130 through a via 132, so as to at least make the two ends of the gain wire 130 electrically connected to the outermost coil turn of the coil layer 110. Further, under the circumstance of a plurality of gain wires 130 (for example, two in FIG. 2), the adjacent gain wires 130 on a vertical plane are connected in parallel through, for example, a plurality of vias 132. The material of the gain wire 130 may be a metal, such as Cu or Cu—Al alloy.

Seen from the above, as long as a gain wire 130 is disposed below the outermost coil turn of the coil layer 110, the cross-sectional area of the conductor may be effectively increased, thereby reducing the conductance loss and improving the inductor quality.

Accordingly, the above embodiments at least have the following advantages.

1. The inductor structure provided by the present invention can alleviate the impact of the eddy current, and improve the inductor quality.

2. With a gain wire, the inductor structure provided by the present invention can effectively increase the cross-sectional area of the conductor, and further improve the inductor quality.

3. The inductor structure provided by the present invention can effectively avoid power loss in the application of a direct current.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An inductor structure, disposed above a substrate, comprising:

a first spiral wire, having a first end and a second end, wherein the first end rotates in a spiral way outward from an inner portion of the first spiral wire; and a second spiral wire, intertwisted with the first spiral wire and symmetrically disposed about a symmetry plane, and having a third end and a fourth end, wherein the third end rotates in a spiral way outward from an inner portion of the second spiral wire and is connected to the first end of the first spiral wire, so as to form a coil layer having a plurality of coil turns.

2. The inductor structure as claimed in claim 1, wherein the first spiral wire and the second spiral wire are interlaced without contacting each other on the symmetry plane.

3. The inductor structure as claimed in claim 1, wherein voltages of a same absolute value and opposite electrical properties are applied to the second end and the fourth end respectively, so as to form a virtual grounding at an outermost coil turn of the coil layer.

4. The inductor structure as claimed in claim 1, further comprising at least one gain wire corresponding to a projection of the outermost coil turn of the coil layer disposed below the coil layer, and connected in parallel with the outermost coil turn of the coil layer.

5. The inductor structure as claimed in claim 4, further comprising a plurality of vias disposed between the coil layer and the gain wire, so as to at least make the two ends of the gain wire electrically connected to the outermost coil turn of the coil layer.

6. The inductor structure as claimed in claim 1, wherein a material of the first spiral wire comprises a metal.

7. The inductor structure as claimed in claim 6, wherein the metal is Cu or Cu—Al alloy.

8. The inductor structure as claimed in claim 1, wherein a material of the second spiral wire comprises a metal.

9. The inductor structure as claimed in claim 8, wherein the metal is Cu or Cu—Al alloy.

10. An inductor structure, disposed above a substrate, comprising:

a first spiral wire, at least comprising a first outer wire and a first inner wire, wherein the first outer wire is connected in series with the first inner wire, and the first outer wire rotates in a spiral way outward from an inner portion of the first spiral wire; and a second spiral wire, intertwisted with the first spiral wire and symmetrically disposed about a symmetry plane, and at least comprising a second outer wire and a second inner wire, wherein the second outer wire is connected in series with the second inner wire, and the second outer wire rotates in a spiral way outward from the inner portion of the second spiral wire and is connected to the first outer wire, so as to form a coil layer having a plurality of coil turns.

11. The inductor structure as claimed in claim 10, wherein the first spiral wire and the second spiral wire are interlaced without contacting each other on the symmetry plane.

12. The inductor structure as claimed in claim 10, further comprising at least one first connection wire and at least one second connection wire, wherein the first connection wire connects the first outer wire and the first inner wire, the second connection wire connects the second outer wire and the second inner wire, and the first connection wire and the second connection wire are symmetrically disposed about the symmetry plane.

13. The inductor structure as claimed in claim 12, wherein the first connection wire is not in contact with the second connection wire.

14. The inductor structure as claimed in claim 10, wherein voltages of a same absolute value and opposite electrical properties are applied to the first inner wire and the second inner wire respectively, so as to form a virtual grounding at an outermost coil turn of the coil layer.

15. The inductor structure as claimed in claim 10, further comprising at least one gain wire corresponding to a projection of the outermost coil turn of the coil layer and disposed below the coil layer, and connected in parallel with the outermost coil turn of the coil layer.

16. The inductor structure as claimed in claim 15, further comprising a plurality of vias disposed between the coil layer and the gain wire, so as to at least make two ends of the gain wire electrically connected to the outermost coil turn of the coil layer.

17. The inductor structure as claimed in claim 10, wherein a material of the first spiral wire comprises a metal.

18. The inductor structure as claimed in claim 17, wherein the metal is Cu or Cu—Al alloy.

19. The inductor structure as claimed in claim 10, wherein a material of the second spiral wire comprises a metal.

20. The inductor structure as claimed in claim 19, wherein the metal is Cu or Cu—Al alloy.

* * * * *